United States Patent [19]

Robbins

[11] 4,381,785

[45] * May 3, 1983

[54] BABY PACIFIER

[75] Inventor: Louis Robbins, Lincoln, R.I.

[73] Assignee: Reliance Products Corporation, Woonsocket, R.I.

[ * ] Notice: The portion of the term of this patent subsequent to May 3, 1997, has been disclaimed.

[21] Appl. No.: 969,740

[22] Filed: Dec. 15, 1978

[51] Int. Cl.[3] ..... A61J 17/00

[52] U.S. Cl. ..... 128/359; 128/360

[58] Field of Search ..... 128/359, 360, 253; 411/15, 508; 24/213 R, 214

[56] References Cited

U.S. PATENT DOCUMENTS

| | | | |
|---|---|---|---|
| 2,520,773 | 8/1950 | Muller | 128/360 X |
| 3,886,949 | 6/1975 | Hurst et al. | 128/360 |
| 3,964,489 | 6/1976 | Kesselring | 128/360 |
| 4,078,570 | 3/1978 | Frodrich et al. | 128/350 |

FOREIGN PATENT DOCUMENTS

| | | | |
|---|---|---|---|
| 2657871 | 6/1978 | Fed. Rep. of Germany | 128/360 |

*Primary Examiner*—Kyle L. Howell
*Assistant Examiner*—Christine A. Fukushima
*Attorney, Agent, or Firm*—Townsend and Townsend

[57] ABSTRACT

The device comprises a hollow, soft rubber baglet which is mounted in the front of a curved shield which positions the baglet in the infant's mouth. The shield is provided with an elongated rectangular opening having peripheral extensions forwardly and rearwardly to form a socket opening. The forwardly extending portion is wider to form a shoulder at the front of the shield. A pair of spaced flat rectangular members are joined at their central rear edges by an integral loop which loosely holds the circular handle for the device. The flat members are provided adjacent their front outer ends with wedge portions forming exterior shoulders. At their opposed faces, the flat members are provided with raised transverse strips which act as pivotal separators for the members. The baglet is pulled through the shield opening so that its open beaded end faces rearwardly. The flat members are inserted in the baglet opening and the assembly is then forced into the rectangular opening in the shield. The transverse strips act as a pivot so that the front edges of the members swing toward each other to allow entry into the opening. Thereafter, the members spring apart sufficiently to allow the shoulders on the members to engage the shoulders in the opening to lock the assembly together.

5 Claims, 5 Drawing Figures

BABY PACIFIER

BACKGROUND OF THE INVENTION

For many years baby pacifiers have been constructed as illustrated in U.S. Pat. No. 2,520,773. This shows the well-known NUK construction in which the baglet is locked to the shield by inserting a plug into the baglet to frictionally hold it in the opening. The handle is mounted at the back of the plug. Variations are also shown in U.S. Pat. Nos. 3,886,949 and 3,964,489. Recently the government has set up certain rigid standards to prevent accidents with the pacifier. It has been found that the constructions heretofore used cannot pass the pull tests, the baglet pulling out of the shield. It is thus necessary to revise the constructions to provide for a more positive locking action.

SUMMARY OF THE INVENTION

The device comprises a hollow, soft rubber baglet which is mounted in the front of a curved shield which positions the baglet in the infant's mouth. The shield is provided with an elongated rectangular opening having peripheral extensions toward the front and rear to form a socket. The forward extension is wider to form a shoulder in the socket in front of the plane of the shield. A pair of spaced flat rectangular members are joined at their central rear edges by an integral loop which loosely holds the annular handle for the pacifier. At their apposed faces, the flat members are provided with raised transverse strips which act as pivotal separators for the members. Adjacent their front outer faces, the members are each provided with a wedge portion forming a shoulder. The baglet is pulled through the shield opening with its beaded open end facing rearwardly. The flat members are inserted in the baglet and the assembly is then forced into the rectangular socket opening. The front ends of the flat members swing toward each other as the members pivot on the strips to allow the members and baglet to enter the socket opening without cracking the shield. After entry, the members pivot away from each other so that the wedges at the front ends engge the shoulder in the socket opening to lock the parts in assembled position.

DESCRIPTION OF THE INVENTION

Figure 1:
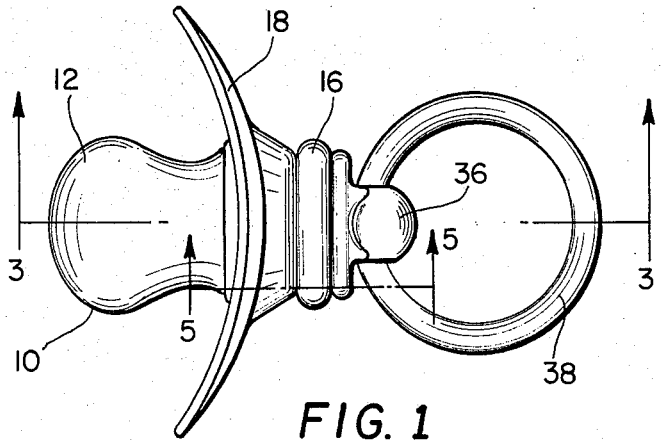
FIG. 1 is a side elevation of a baby pacifier embodying my present invention.
Figure 2:
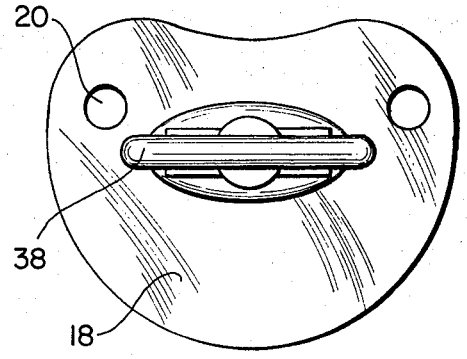
FIG. 2 is a rear view thereof.

The pacifier of the present invention comprises the baglet 10 made of a suitable material such as soft rubber or plastic and having a front end 12 to be inserted in the baby's mouth, and a shank 14 having a beaded opening 16. The baglet 10 is normally mounted in a shield 18 at right angles. The shield 18 is illustrated as oval and curved, but can be any desirable shape and can be straight instead of curved. The shield 18 is provided with openings 20 as required for safety.

Figure 3:
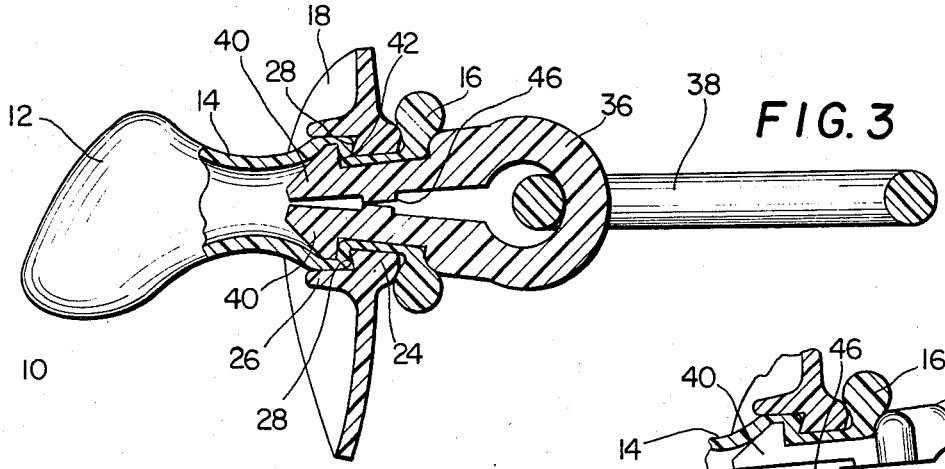
FIG. 3 is a section taken on line 3—3 on FIG. 1.
Figure 4:
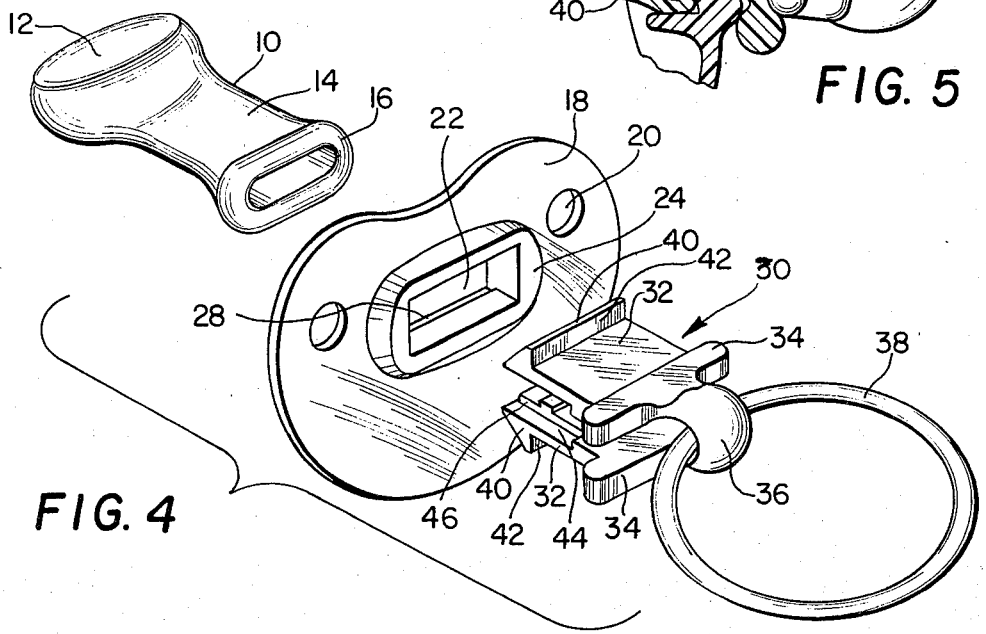
FIG. 4 is an exploded perspective view of the pacifier assembly.

To anchor the baglet 10 in the shield 18, the shield is provided with a central, elongated, rectangular opening 22, FIG. 4. The opening 22 is provided with peripheral portion 24 extending rearwardly and peripheral shoulder portion 26 extending forwardly to form a socket opening. The forwardly extending shoulder portion 26 is larger, forming a set-back 28 just forwardly of the plane of the shield, FIG. 3.

The locking action is provided by the member 30. This member comprises a pair of spaced, flat, rectangular, rigid plastic members or leaves 32 each with a thickened rear edge portion 34 wider than the members 32 to form stop shoulders. An integral centrally located loop 36 connects the members 32 at their rear edge and holds them resiliently in the spaced relation shown in FIG. 4. An annular plastic handle 38 passes through the loop 36 to be loosely held therein, FIG. 3.

Figure 5:
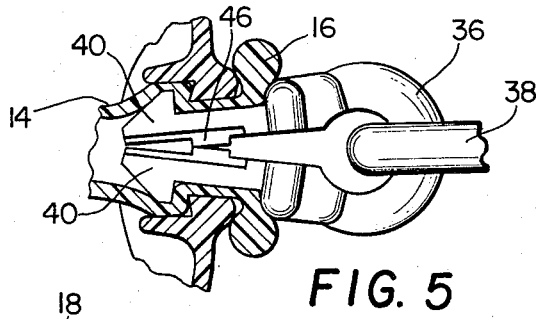
FIG. 5 is a section taken on line 5—5 on FIG. 1.

At the front edges, the members 32 are provided with integral wedge portions 40 which form rearwardly facing shoulders 42. Also, along one side edge, the members 32 are provided with cut-away portions 44 facing each other to form a passageway when the members 32 are mounted in assembled position as shown in FIGS. 4 and 5. Spaced from the front edges, each member 32 is provided with an integral, raised strip or fulcrum 46 extending transversely of the members and serving to space the members at this point.

In assembly, the beaded end 16 of the baglet 10 is pushed through the front of the socket opening 22. The member 30 is inserted until the rear edge portion 34 reaches the beaded edge. The assembly is then forced into the opening 22 by any suitable means, such as an electrical or pneumatic ram, etc. As the assembly enters the opening 22, the wedges 40 engage the top and bottom edges of the opening and the front edges of the members are forced toward each other, the members pivoting on the strips 46. This prevents damage to the shield which may be caused by undue pressure on the opening during assembly.

The assembly is moved forwardly until it reaches the enlarged front portion of the socket opening. At this point, due to the inherent "memory" of the plastic material, the front ends of the members 32 tend to pivot apart and force the shoulders 42 on the wedges to engage the set-back 28 in the opening while pinching and holding the baglet 10 therebetween, FIG. 3. This engagement of the shoulder 42 and the set-back 28 effectively locks the assembly together against the strongest pulls far greater than required by government safety tests. The "memory" of the plastic material of the members 32 enhanced by the pivot action of the strips 46, ensures a firm interlock at the set-back 28 and the shoulder 42. The passageway formed by the cut-away portions 44 serve to communicate the inside of the baglet with the outer air to prevent the baglet from collapsing.

The resultant pacifier meets all government specifications and tests. The handle is firmly anchored but is loosely held as required. The assembly does not pull apart. Furthermore, the unique construction lends itself to simple and easy assembly at a minimal cost. Other advantages of the present invention will be readily apparent to a person skilled in the art.

I claim:

1. A baby pacifier comprising:

a shield having a baglet side, a handle side, and a centrally disposed rectangular hole surrounded on the baglet side by a set-back and a first shoulder, and surrounded on the handle side by a second shoulder;

an elastic baglet having a tubular shack disposed through said hole, said shank terminating in a circumferential bead;

a plug clamp having a semicircular loop ending in a pair of third shoulders which extend into a pair of parallel spaced leaves, said leaves terminating in transverse wedges which together form an acute angle opposite said loop, each wedge having a perpendicular fourth shoulder facing said loop, the mutually facing insides of said leaves each having a fulcrum parallel to said wedge approximately midway between said wedge and said loop;

whereby as said clamp is forced into said hole and elastic baglet shank, each of the leaves pivots around its respective fulcrum until the wedges meet in a point and squeeze through the shank, whereupon, through said baglet, said second and third shoulders abut and said wedges pivot apart as said fourth shoulder latches across said set-back to the first shoulder.

2. A baby pacifier as in claim 1 wherein said elastic baglet is hollow.

3. A baby pacifier as in claim 2 wherein said fulcrums have a gap to maintain a passageway between said leaves for air to pass in and out of said baglet.

4. A baby pacifier as in claim 2 wherein said shield is curved concavely toward said baglet side.

5. A baby pacifier as in claim 2 wherein an annular handle extends through said semicircular loop.

* * * * *